US005485694A

United States Patent [19]

Goad

[11] Patent Number: 5,485,694

[45] Date of Patent: Jan. 23, 1996

[54] DOOR-MOUNTED POSTER SUPPORT

[76] Inventor: Sharon E. Goad, 429 Ritchie Dr., Nashville, Tenn. 37220

[21] Appl. No.: 376,083

[22] Filed: Jan. 23, 1995

Related U.S. Application Data

[63] Continuation of Ser. No. 103,204, Aug. 9, 1993, abandoned.

[51] Int. Cl.[6] ..... G09F 7/02

[52] U.S. Cl. ..... 40/661; 40/611

[58] Field of Search ..... 40/594, 611, 617, 40/661; 52/38

[56] References Cited

U.S. PATENT DOCUMENTS

| | | | |
|---|---|---|---|
| 2,411,368 | 11/1946 | Dow | 40/661 X |
| 4,244,512 | 1/1981 | Wise | 40/661 X |
| 4,914,844 | 4/1990 | Seery | 52/38 X |
| 5,305,537 | 4/1994 | Pascarelli | 40/661 X |

FOREIGN PATENT DOCUMENTS

| | | | |
|---|---|---|---|
| 2231551 | 11/1990 | United Kingdom | 40/594 |

*Primary Examiner*—Brian K. Green

[57] ABSTRACT

A new and improved door-mounted poster support apparatus includes a U-shaped base member assembly which includes a middle base portion capable of resting on an upper surface of a door, and which also includes a first hanging base member which hangs from a first side of the middle base portion and a second hanging base member which hangs from a second side of the middle base portion. A transparent U-shaped cover assembly includes a middle cover portion capable of resting on the middle base portion. A first hanging cover member hangs from a first side of the middle cover portion and substantially covers the first hanging base member. A second hanging cover member hangs from a second side of the middle cover portion and substantially covers the second hanging base member. A closure assembly, in the form of a J-shaped lip, is located at respective bottom edges of the first hanging base member and the first hanging cover member for retaining a poster that is sandwiched between the first hanging base member and the first hanging cover member. A plurality of transparent plastic overlays may be provided that are capable of fitting onto the first hanging cover member. An add-on support assembly may be provided for a small item to be displayed on the first hanging cover member.

12 Claims, 4 Drawing Sheets

DOOR-MOUNTED POSTER SUPPORT

This application is a continuation of application Ser. No.08/103,204, filed Aug. 9 1993, now abandoned.

BACKGROUND OF THE INVENTION

1. Field of the Invention

The present invention relates generally to devices for displaying large flat objects, and, more particularly, to devices especially adapted for displaying posters.

2. Description of the Prior Art

Posters, which are generally large photographs or prints that are nearly life size, are popular with many people, especially young people, and are often displayed on the walls of a person's room. In order to display a poster on a wall, the poster must be mounted on the wall, and mounting the posters often creates problems. A number of ways are commonly employed to mount posters on walls. The use of adhesive tape, thumb tacks, staples, contact adhesive, and nails are just some common ways used for mounting posters on walls. However, each one of these ways has a common disadvantage—the risk of doing damage to the wall. Thumb tacks, staples, and nails create holes in the wall. Adhesive materials often adhere so strongly to the walls that wall coverings, such as wall paper or paint, are pulled off of the walls when a poster mounted with them is removed from a wall. In this respect, it would be desirable if a device were provided for displaying a poster in a room which did not create holes in walls. Also, it would be desirable if a poster display device were provided which did not pull wall coverings off of walls when posters are removed.

Walls in rooms often have thin wall coverings such as wall paper and paint over wall board materials. Wall board materials often have an outer layer of paper covering inner, insulative materials. A problem associated with removal of adhesives materials from such walls, is that the removed adhesive materials often tear away some of the paper which is the outer layer of the wall board. In this respect, it would be desirable if a device were provided for displaying a poster in a room which did not tear away any of the outer paper layer of wall board when the poster is removed or relocated in the room.

Another problem associated with conventional poster display methods is the damage that is done to the poster. Thumb tacks, staples, and nails create holes in the posters as well. In addition, the adhesives often adhere so strongly to the posters that the posters are torn or otherwise damaged when an effort is made to remove the adhesive materials. In this respect, it would be desirable if a device were provided for displaying a poster in a room which did not make holes in the poster. Also, it would be desirable if a poster display device were employed that did not cause any form of damage to the poster when the poster is removed from its display location.

When a poster is shipped or carried from place to place, it is often rolled up and placed in a narrow diameter cylindrical container. As a result, the poster initially has a tendency to curl. When conventional means are used to display posters on walls, only an installers hands are used to overcome the poster's tendency to curl. However, the surface area of a person's hand is much smaller than the surface area of poster. As a result, the person's hand is often inadequate for helping to take the curl out of the poster. In this respect, it would be desirable if a device were provided for displaying a poster in a room which helped remove the curl from a poster that was contained in a narrow diameter cylindrical container.

Throughout the years, a number of innovations have been developed relating to displaying posters, and the following U.S. patents are representative of some of those innovations: U.S. Pat. Nos. 4,523,400; 4,936,033; 4,976,055; 5,090,143; and Des. 326,027. More specifically, U.S. Pat. No. 4,523,400 a poster frame and display holder that is either installed on a wall or free standing. When a poster frame is installed on a wall, the wall undergoes damage due to the frame. When the poster frame is free standing, it undesirably takes up floor space. In this respect, it would be desirable if a device were provided for displaying a poster in a room which did not take up floor space. The other patents mentioned above also disclose wall-mounted poster displays.

At times, to avoid damaging walls as described above, some people mount posters on doors. However, some of the problems of damaging walls are merely transformed into similar problems for doors. In this respect, it would be desirable if a device were provided for displaying a poster in a room which employs a door for displaying the poster without subjecting the door to holes formed in the doors.

Posters are not the only items that people often display in a room. People often display relatively small photographs or small prints on walls. The photographs may be small enough to place on a desk top or a table top in a frame, but some people prefer to display them on vertical surfaces in the room anyway. In this respect, it would be desirable if a device were provided for displaying a relatively small photograph or print in a room which did not do damage to any of the walls in the room.

Just as a person may desire to display a relatively small photograph or print on a wall in a room, the person may desire to display the photograph or print on a door for the room. In this respect, it would be desirable if a device were provided which can display a relatively small photograph or print on a door without doing damage to the door.

Posters, photographs, and prints are decorative in their own right. However, there may be times when a person would like to add some original and personal modification to the poster, photograph, or print as a personal expression of creativity. When such is the case, it must be realized that the person may later change his/her mind as to the specific modifications that were made. If such were the case, it would be desirable if a device were provided which permitted specific personal touches to be removed or reversed without damaging an original poster, photograph, or print.

Thus, while the foregoing body of prior art indicates it to be well known to use displaying posters, the prior art described above does not teach or suggest a door-mounted poster support apparatus which has the following combination of desirable features: (1) does not create holes in walls; (2) does not pull wall coverings off of walls when posters are removed; (3) does not make holes in the poster; (4) does not cause any form of damage to the poster when the poster is removed from its display location; (5) helps remove the cud from a poster that has been contained in a narrow diameter cylindrical container; (6) does not tear away any of the outer paper layer of wall board when the poster is removed or relocated in the room; (7) does not take up floor space; (8) employs a door for displaying the poster without subjecting the door to holes formed in the doors; (9) displays a relatively small photograph or print in a room and does not do damage to any of the walls in the room; (10) can display a relatively small photograph or print on a door without doing damage to the door; and (11) permits specific personal touches used to embellish a poster to be removed or reversed without damaging an original poster, photograph, or print. The foregoing desired characteristics are provided by the unique door-mounted poster support apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved door-mounted poster support apparatus which includes a U-shaped base member assembly which includes a middle base portion capable of resting on an upper surface of a door, and which also includes a first hanging base member which hangs from a first side of the middle base portion and a second hanging base member which hangs from a second side of the middle base portion. A transparent U-shaped cover assembly includes a middle cover portion capable of resting on the middle base portion. A first hanging cover member hangs from a first side of the middle cover portion and substantially covers the first hanging base member. A second hanging cover member hangs from a second side of the middle cover portion and substantially covers the second hanging base member. A closure assembly is located at respective bottom edges of the first hanging base member and the first hanging cover member for retaining a poster that is sandwiched between the first hanging base member and the first hanging cover member.

The cover assembly is comprised of flexible transparent plastic material and is a unified one-piece structure. The U-shaped base member assembly is comprised of flexible plastic material and is also a unified one-piece structure. The U-shaped base member assembly is comprised of a transparent material.

The closure assembly includes a first J-shaped lip which turns upward from a bottommost portion of the first hanging base member, such that a bottom edge of the first hanging cover member fits into the first J-shaped lip of the first hanging base member, whereby a poster sandwiched between the first hanging base member and the first hanging cover member is prevented from falling away from the first hanging base member and the first hanging cover member by the first J-shaped lip. A second J-shaped lip turns upward from a bottommost portion of the second hanging member.

The middle base portion and the middle cover portion are connected together. The middle base portion and the middle cover portion may be connected together by a quantity of an adhesive material.

The middle base portion may be adhered to the upper surface of the door by an adhesive strip. The second hanging base member is adhered to a side surface of a door by an adhesive strip.

A plurality of transparent plastic overlays may be provided that are capable of fitting onto the first hanging cover member. The overlays fit onto the first hanging cover member by contact forces such as contact forces due to static electricity.

An add-on support assembly may be provided for a small item to be displayed on the first hanging cover member. The add-on support assembly includes an adhesive strip for supporting the add-on support assembly on the first hanging cover member. A transparent housing includes a plurality of walls which define a pocket for receiving the item to be displayed in the add-on support assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved door-mounted poster support apparatus which has all of the advantages of the prior art and none of the disadvantages.

It is another object of the present invention to provide a new and improved door-mounted poster support apparatus which may be easily and efficiently manufactured and marketed.

It is a further object of the present invention to provide a new and improved door-mounted poster support apparatus which is of durable and reliable construction.

An even further object of the present invention is to provide a new and improved door-mounted poster support apparatus which is susceptible of a low cost of manufacture with regard to both materials and labor, and which accordingly is then susceptible of low prices of sale to the consuming public, thereby making such door-mounted poster support apparatus available to the buying public.

Still yet a further object of the present invention is to provide a new and improved door-mounted poster support apparatus which does not create holes in walls.

Still another object of the present invention is to provide a new and improved door-mounted poster support apparatus that does not pull wall coverings off of walls when posters are removed.

Yet another object of the present invention is to provide a new and improved door-mounted poster support apparatus which does not make holes in the poster.

Even another object of the present invention is to provide a new and improved door-mounted poster support apparatus that does not cause any form of damage to the poster when the poster is removed from its display location.

Still a further object of the present invention is to provide a new and improved door-mounted poster support apparatus which helps remove the curl from a poster that has been contained in a narrow diameter cylindrical container.

Yet another object of the present invention is to provide a new and improved door-mounted poster support apparatus that does not tear away any of the outer paper layer of wall board when the poster is removed or relocated in the room.

An even further object of the present invention is to provide a new and improved door-mounted poster support apparatus which does not take up floor space.

Yet another object of the present invention is to provide a new and improved door-mounted poster support apparatus that employs a door for displaying the poster without subjecting the door to holes formed in the doors.

Still a further object of the present invention is to provide a new and improved door-mounted poster support apparatus that displays a relatively small photograph or print in a room and does not do damage to any of the walls in the room.

Yet another object of the present invention is to provide a new and improved door-mounted poster support apparatus which can display a relatively small photograph or print on a door without doing damage to the door.

Still yet a further object of the present invention is to provide a new and improved door-mounted poster support apparatus that permits specific personal touches used to embellish a poster to be removed or reversed without damaging an original poster, photograph, or print.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved door-mounted poster support apparatus embodying the principles and concepts of the present invention will be described.

Figure 1:
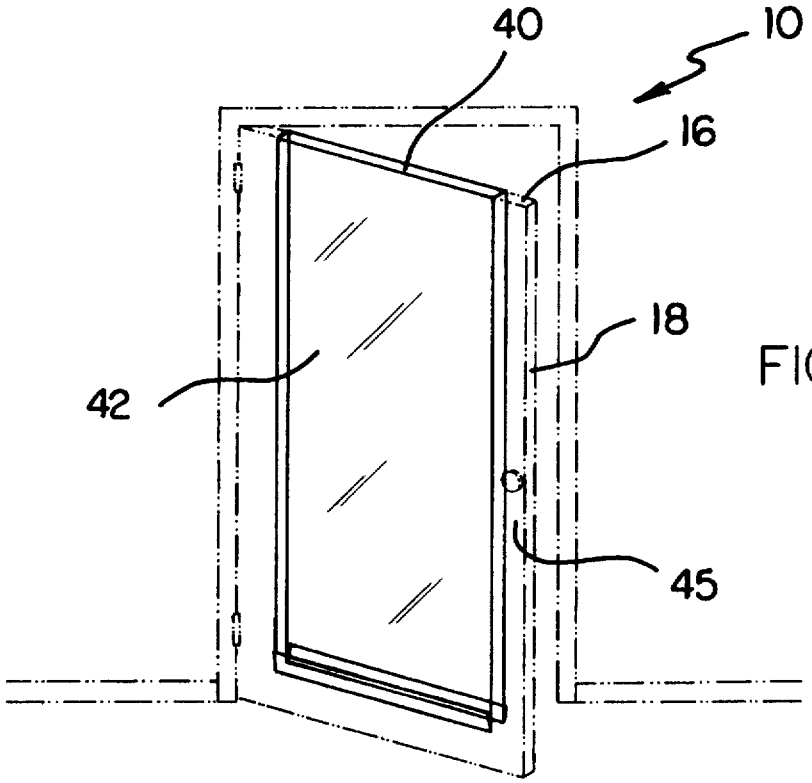
FIG. 1 is a perspective view showing a first preferred embodiment of the door-mounted poster support apparatus of the invention mounted on a door.
Figure 2:
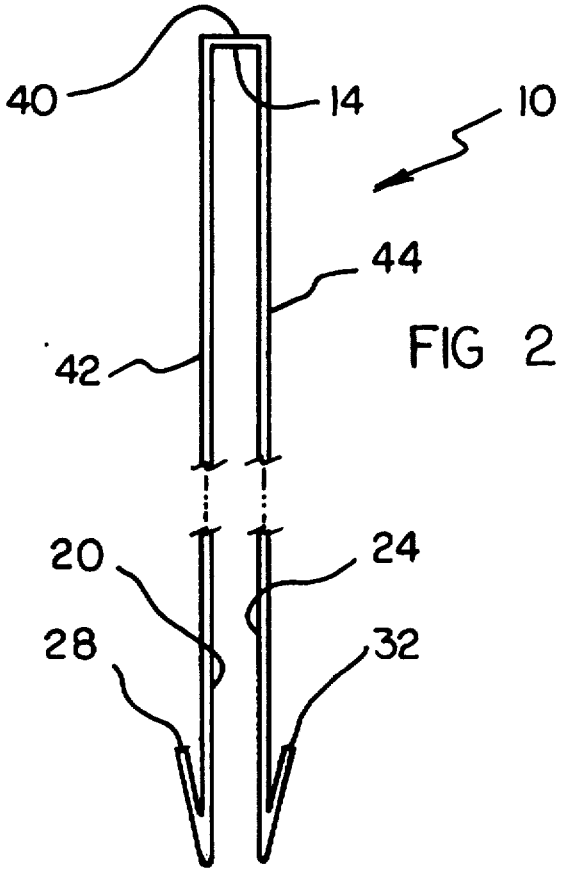
FIG. 2 is an edge view of the embodiment of the door-mounted poster support apparatus shown in FIG. 1.

Turning initially to FIGS. 1–2, there is shown a first exemplary embodiment of the door-mounted poster support apparatus of the invention generally designated by reference numeral 10. Features of the first embodiment are also found in FIGS. 3 and 4. In its preferred form, door-mounted poster support apparatus 10 includes a U-shaped base member assembly which includes a middle base portion 14 capable of resting on an upper surface 16 of a door 18, and which also includes a first hanging base member 20 which hangs from a first side 22 of the middle base portion 14 and a second hanging base member 24 which hangs from a second side 26 of the middle base portion 14. A transparent U-shaped cover assembly 36 includes a middle cover portion 40 capable of resting on the middle base portion 14. A first hanging cover member 42 hangs from a first side 43 of the middle cover portion 40 and substantially covers the first hanging base member 20. A second hanging cover member 44 hangs from a second side 46 of the middle cover portion 40 and substantially covers the second hanging base member 24. A closure assembly is located at respective bottom edges of the first hanging base member 20 and the first hanging cover member 42 for retaining a poster (not shown) that is sandwiched between the first hanging base member 20 and the first hanging cover member 42.

The cover assembly 36 is comprised of flexible transparent plastic material and is a unified one-piece structure. The U-shaped base member assembly is comprised of flexible plastic material and is also a unified one-piece structure. The U-shaped base member assembly is comprised of a transparent material.

The closure assembly includes a first J-shaped lip 28 which turns upward from a bottommost portion 30 of the first hanging base member 20, such that a bottom edge of the first hanging cover member 42 fits into the first J-shaped lip 28 of the first hanging base member 20, whereby a poster sandwiched between the first hanging base member 20 and the first hanging cover member 42 is prevented from falling away from the first hanging base member 20 and the first hanging cover member 42 by the first J-shaped lip 28. A second J-shaped lip 32 turns upward from a bottommost portion 34 of the second hanging member 24.

The middle base portion 14 and the middle cover portion 40 are connected together. The middle base portion 14 and the middle cover portion 40 may be connected together by a quantity of an adhesive material. Alternatively, the middle base portion 14 and the middle cover portion 40 can be fused together.

Figure 3:
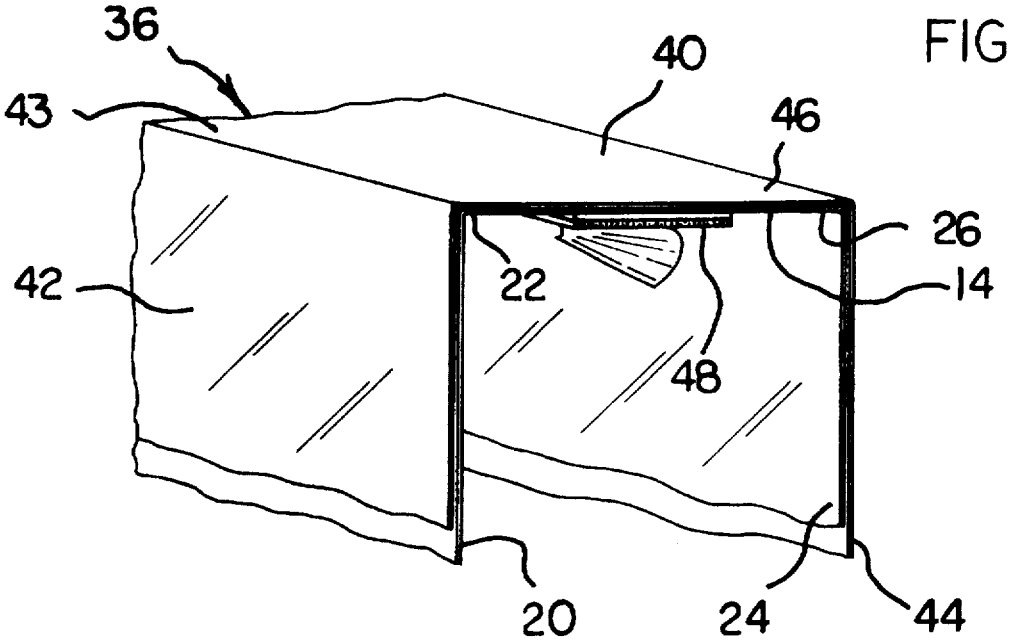
FIG. 3 is a partial perspective view of a top portion of a second embodiment of the door-mounted poster support apparatus of the invention.
Figure 4:
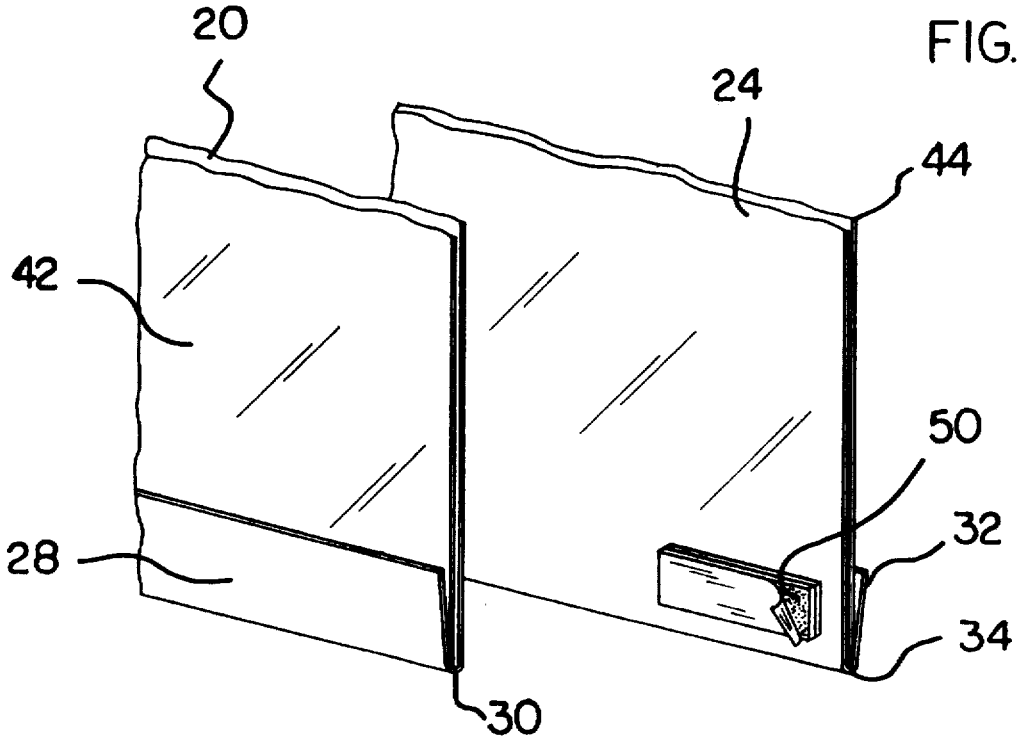
FIG. 4 is a partial perspective view of the bottom portion of the embodiment of the invention shown in FIG. 3.

As shown in FIG. 3, in a second embodiment of the invention, the middle base portion 14 is adhered to the upper surface 16 of the door 18 by an adhesive strip 48. As shown in FIG. 4, the second hanging base member 24 is adhered to a side surface 45 of a door 18 by an adhesive strip 50.

The closure assembly can take other forms. For example, quantity of a tacky adhesive can be placed near the bottom edge of either the first hanging base member 20 or the first hanging cover member 42. In this respect, a tacky adhesive is an adhesive which forms a relatively weak and easily separated bond without pulling off substrate materials, such as coats of paint, when the bond is broken. The tacky adhesive will assure that the first hanging base member 20 and the first hanging cover member 42 stay fixed to each other to assure that the poster displayed therebetween will not fall out from between them. The tacky adhesive forms a temporary bond that can easily be broken when the first hanging base member 20 is separated from the first hanging cover member 42 to allow a poster to be either removed or replaced.

In use, the door-mounted poster support apparatus 10 of the invention is installed on a door 18. The middle base portion 14 rests upon the upper surface 16 of the door 18, and the first hanging base member 20 and the second hanging base member 24 hang down from the middle base portion 14 by straddling the door 18 therebetween. To install a poster (not shown), the first hanging cover member 42 is lifted away from the first hanging base member 20, and the poster is placed against the first hanging base member 20. Then, the first hanging cover member 42 is lowered onto the poster to sandwich it between the first hanging base member 20 and the first hanging cover member 42. The bottom edge of the first hanging cover member 42 is locked into the angular formation formed by the first J-shaped lip 28 and the first hanging base member 20.

Figure 5:
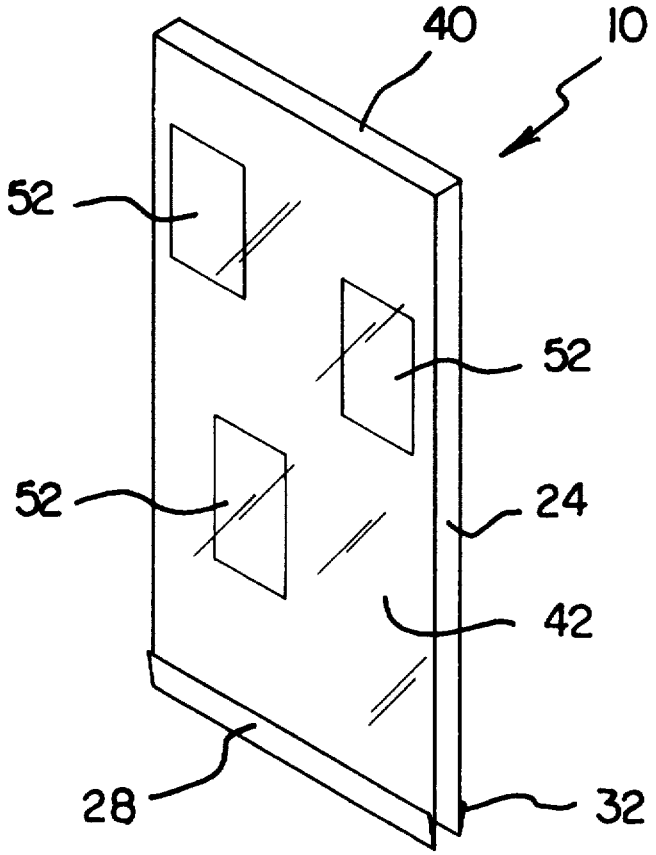
FIG. 5 is a perspective view of a third embodiment of the door-mounted poster support apparatus which employs transparent add-on sheets.
Figure 6:
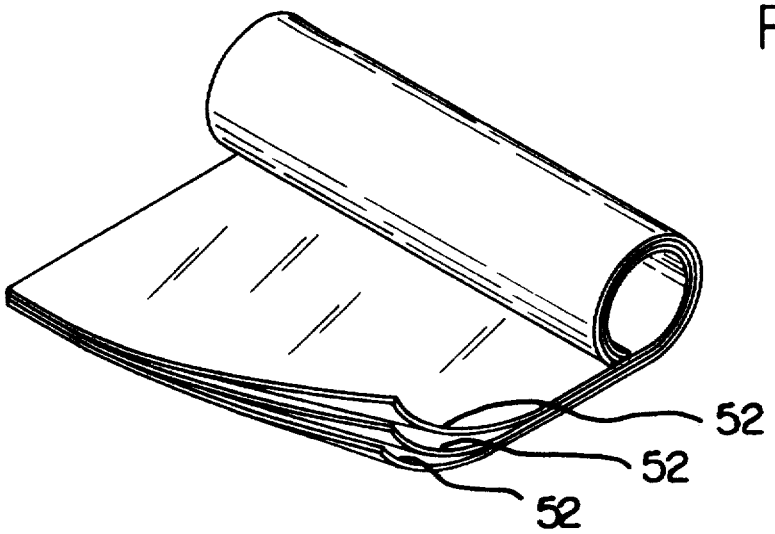
FIG. 6 is a perspective view of a stack of add-on sheets used in the embodiment shown in FIG. 5.

Turning to FIGS. 5–6, a third embodiment of the invention is shown. Reference numerals are shown that correspond to like reference numerals that designate like elements shown in the other figures. In addition, a plurality of transparent plastic overlays 52 are provided that are capable of fitting onto the first hanging cover member 42. The overlays 52 fit onto the first hanging cover member 42 by contact forces such as contact forces due to static electricity. Alternatively, a tacky adhesive can be used to adhere the overlays 52 to the first hanging cover member 42. In this respect, a tacky adhesive is an adhesive which forms a relatively weak and easily separated bond without pulling off substrate materials, such as coats of paint, when the bond is broken.

Figure 7:
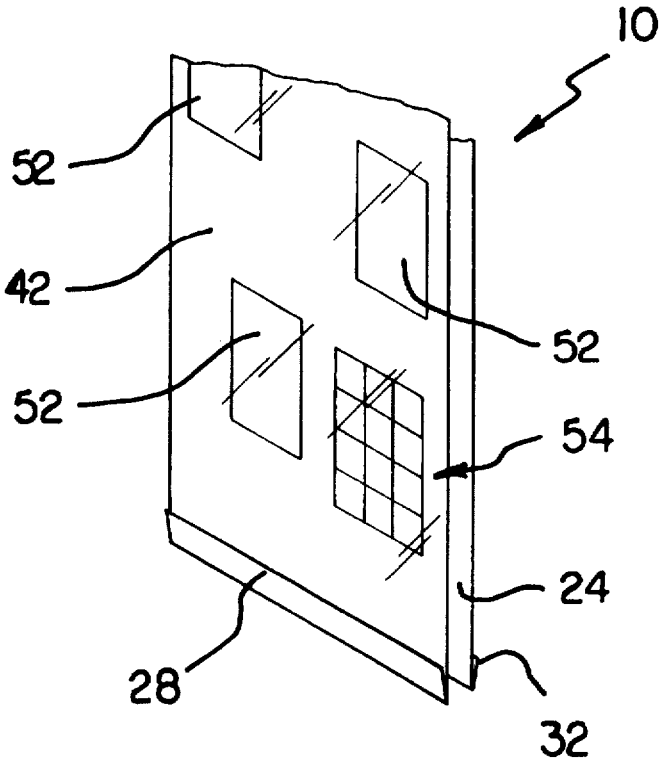
FIG. 7 is a partial perspective view of a fourth embodiment of the door-mounted poster support apparatus of the invention which also includes add-on supports for small items to be displayed.
Figure 8:
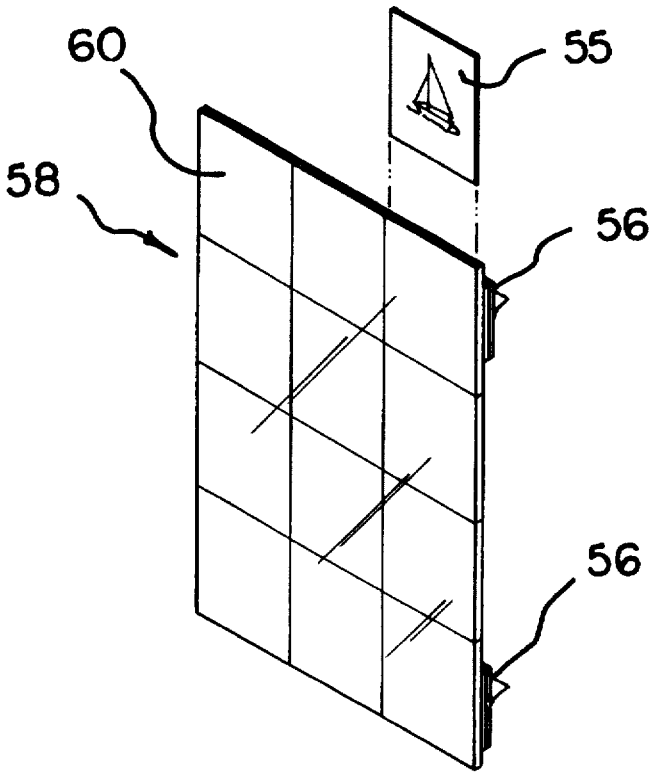
FIG. 8 is an enlarged perspective view of an add-on small item display support shown in FIG. 7.

Turning to FIGS. 7-8, a fourth embodiment of the invention is shown. Reference numerals are shown that correspond to like reference numerals that designate like elements shown in the other figures. In addition, an add-on support assembly 54 is provided for a small item 55 to be displayed on the first hanging cover member 42. The add-on support assembly 54 includes an adhesive strip 56 for supporting the add-on support assembly 54 on the first hanging cover member 42. A transparent housing 58 includes a plurality of walls 60 which define a pocket for receiving the item 55 to be displayed in the add-on support assembly 54.

As shown in FIGS. 7 and 8, a plurality of items 55, e.g. photographs, are supported by the add-on support assembly 54. As shown in FIG. 8, the small item 55 can be lowered into the pocket of the add-on support assembly 54.

Although large posters can be displayed with the door-mounted poster support apparatus 10 of the invention, it is understood that the apparatus of the invention can be used for the display of a variety of items which includes magazine pictures and pictures of actors and entertainers. The door-mounted poster support apparatus 10 of the invention can be rolled up and packaged and stored in a cylindrical container similar to the containers used for packaging and storing posters.

The components of the door-mounted poster support apparatus of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved door-mounted poster support apparatus that is low in cost, relatively simple in design and operation, and which may advantageously be used to support a poster without creating holes in walls. With the invention, a door-mounted poster support apparatus is provided which does not pull wall coverings off of walls when posters are removed. With the invention, a door-mounted poster support apparatus is provided which does not make holes in the poster. With the invention, a door-mounted poster support apparatus is provided which does not cause any form of damage to the poster when the poster is removed from its display location. With the invention, a door-mounted poster support apparatus is provided which helps remove the curl from a poster that has been contained in a narrow diameter cylindrical container. With the invention, a door-mounted poster support apparatus is provided which does not tear away any of the outer paper layer of wall board when the poster is removed or relocated in the room. With the invention, a door-mounted poster support apparatus is provided which does not take up floor space. With the invention, a door-mounted poster support apparatus is provided which employs a door for displaying the poster without subjecting the door to holes formed in the doors. With the invention, a door-mounted poster support apparatus is provided which displays a relatively small photograph or print in a room and does not do damage to any of the walls in the room. With the invention, a door-mounted poster support apparatus is provided which can display a relatively small photograph or print on a door without doing damage to the door. With the invention, a door-mounted poster support apparatus is provided which permits specific personal touches used to embellish a poster to be removed or reversed without damaging an original poster, photograph, or print.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A door-mounted poster support apparatus, comprising:

a U-shaped base member assembly which includes a middle base portion adapted to rest on an upper surface of a door which has a front and a back side depending perpendicularly downward from said upper surface, and which also includes a first flexible plastic hanging base member which is connected perpendicularly to a first side of said middle base portion and is sufficiently flexible so as to hang substantially vertically from said first side of said middle base portion for covering a substantial portion of either the front or back side of the door and a second flexible plastic hanging base member which is connected perpendicularly to a second side of said middle base portion and is sufficiently flexible so as to hang substantially vertically from said second side of said middle base portion when said middle base portion rests on the upper surface of the door for covering a substantial portion of an opposite side of the door substantially covered by said first flexible plastic hanging base member, a transparent U-shaped cover assembly which includes a middle cover portion adapted to rest on said middle base portion, and which also includes a first flexible plastic hanging cover member which is connected perpendicularly to a first side of said middle cover portion and which is sufficiently flexible so as to hang substantially vertically from said first side of said middle cover portion and which substantially covers said first flexible plastic hanging base member and a second flexible plastic hanging cover member which is connected perpendicularly to a second side of said middle cover portion and is sufficiently flexible so as to hang substantially vertically from said second side of said middle cover portion and which substantially covers said second flexible plastic hanging base member when said middle base portion rests on the upper surface of the door, and a selectively closable and openable closure assembly located at respective bottom edges of said first flexible plastic hanging base member and said first flexible plastic hanging cover member for retaining a poster that is sandwiched between said first flexible plastic hanging base member and said first flexible plastic hanging cover member, said selectively closable and openable closure assembly including a first J-shaped lip which turns upward from a bottommost portion of said first flexible plastic hanging base member, such that a bottom edge of said first flexible plastic hanging cover member fits into said first J-shaped lip of said first flexible plastic hanging base member, whereby a poster sandwiched between said first flexible plastic hanging base member and said first flexible plastic hanging cover member is prevented from falling away from said first flexible plastic hanging base member and said first flexible plastic hanging cover member by said first J-shaped lip.

2. The apparatus described in claim 1 wherein said U-shaped base member assembly is comprised of a transparent material.

3. The apparatus described in claim 1 wherein said middle base portion and said middle cover portion are connected together.

4. The apparatus described in claim 3 wherein said middle base portion and said middle cover portion are connected together by a quantity of an adhesive material.

5. The apparatus described in claim 1 wherein said middle base portion includes an adhesive strip coupled thereto adapted to be adhered to the upper surface of the door.

6. The apparatus described in claim 1 wherein said second flexible plastic hanging base member includes an adhesive strip coupled thereto adapted to be adhered to a side surface of a door.

7. The apparatus described in claim 1, further including:

a plurality of transparent plastic overlays that are adapted to fit onto said first flexible plastic hanging cover member.

8. The apparatus described in claim 13 wherein said overlays fit onto said first flexible plastic hanging cover member by forces due to static electricity.

9. The apparatus described in claim 1, further including:

an add-on support assembly for a small item to be displayed on said first hanging cover member, said add-on support assembly adapted to attach to said first flexible plastic hanging cover member.

10. The apparatus described in claim 9 wherein said add-on support assembly includes:

an adhesive strip for supporting said add-on support assembly on said first flexible plastic hanging cover member, and a transparent housing which includes a plurality of walls which define a pocket for receiving the item to be displayed in said add-on support assembly.

11. A new and improved door-mounted poster support apparatus, comprising:

a U-shaped base member assembly which includes a middle base portion adapted to rest on an upper surface of a door, and which also includes a first hanging base number which is adapted to hang from a first side of said middle base portion and a second hanging base member which is adapted to hang from a second side of said middle base portion when said middle base portion rests on an upper surface of the door, a transparent U-shaped cover assembly which includes a middle cover portion adapted to rest on said middle base portion, and which also includes a first hanging cover member which adapted to hang from a first side of said middle cover portion and which substantially covers said first hanging base member and a second hanging cover member which is adapted to hang from a second side of said middle cover portion and which substantially covers said second hanging base member when said middle base portion rests on an upper surface of the door, and a closure assembly located at respective bottom edges of said first hanging base member and said first hanging cover member for retaining a poster that is sandwiched between said first hanging base member and said first hanging cover member, wherein said closure assembly includes a first J-shaped lip which turns upward from a bottommost portion of said first hanging base member, such that a bottom edge of said first hanging cover member fits into said first J-shaped lip of said first hanging base member, whereby a poster sandwiched between said first hanging base member and said first hanging cover member is prevented from falling away from said first hanging base member and said first hanging cover member by said first J-shaped lip, and wherein said closure assembly includes a second J-shaped lip which turns upward from a bottommost portion of said second hanging member.

12. A door-mounted poster support apparatus comprising:

a U-shaped base member assembly which includes a middle base portion adapted to rest on an upper surface of a door which has a front and a back side depending perpendicularly downward from said upper surface, and which also includes a first flexible plastic hanging base member which is connected perpendicularly to a first side of said middle base portion and is sufficiently flexible so as to hang substantially vertically from said first side of said middle base portion for covering a substantial portion of either the front or back side of the door and a second flexible plastic hanging base member which is connected perpendicularly to a second side of said middle base portion and is sufficiently flexible so as to hang substantially vertically from said second side of said middle base portion when said middle base portion rests on the upper surface of the door for covering a substantial portion of an opposite side of the door substantially covered by said first flexible plastic hanging base member, a transparent U-shaped cover assembly which includes a middle cover portion adapted to rest on said middle base portion, and which also includes a first flexible plastic hanging cover member which is connected perpendicularly to a first side of said middle cover portion and which is sufficiently flexible so as to hang substantially vertically from said first side of said middle cover portion and which substantially covers said first flexible plastic hanging base member and a second flexible plastic hanging cover member which is connected perpendicularly to a second side of said middle cover portion and is sufficiently flexible so as to hang substantially vertically from said second side of said middle cover portion and which substantially covers said second flexible plastic hanging base member when said middle base portion rests on the upper surface of the door, and a selectively closable and openable closure assembly located at respective bottom edges of said first flexible plastic hanging base member and said first flexible plastic hanging cover member for retaining a poster that is sandwiched between said first flexible plastic hanging base member and said first flexible plastic hanging cover member, wherein said middle base portion and said middle cover portion are connected together by a quantity of adhesive material.

* * * * *